United States Patent [19]

Kidera

[11] Patent Number: 4,708,604

[45] Date of Patent: Nov. 24, 1987

[54] PRESSURE SURFACE FOR A PERISTALTIC PUMP

[75] Inventor: Edward H. Kidera, Bristol, Wis.

[73] Assignee: Abbott Laboratories, North Chicago, Ill.

[21] Appl. No.: 906,666

[22] Filed: Sep. 12, 1986

Related U.S. Application Data

[63] Continuation of Ser. No. 817,793, Jan. 9, 1986, abandoned, which is a continuation of Ser. No. 638,597, Aug. 7, 1984, abandoned.

[51] Int. Cl.[4] ..... F04B 43/12; F04B 45/08

[52] U.S. Cl. ..... 417/477

[58] Field of Search ..... 417/474, 475, 476, 477; 121/DIG. 12; 604/151, 153

[56] References Cited

U.S. PATENT DOCUMENTS

| | | | |
|---|---|---|---|
| 3,011,684 | 12/1961 | Corneil | 417/477 |
| 3,353,491 | 11/1967 | Bastian | 417/477 |
| 4,189,286 | 2/1980 | Murry et al. | 417/477 |
| 4,487,604 | 12/1984 | Iwatschenko et al. | 417/477 X |

FOREIGN PATENT DOCUMENTS

| | | | |
|---|---|---|---|
| 2102503 | 2/1983 | United Kingdom | 417/477 |

*Primary Examiner*—Leonard E. Smith

*Attorney, Agent, or Firm*—Janet K. Hochstetler; Martin L. Katz

[57] ABSTRACT

A pressure plate for a peristaltic pump utilizing flexible tubing has an arcuate surface and a pivot mount. The arcuate surface is retained in operative association with the flexible tubing by a spring bias.

1 Claim, 5 Drawing Figures

PRESSURE SURFACE FOR A PERISTALTIC PUMP

This application is a continuation of application Ser. No. 817,793, filed 1/9/86, now abandoned, which is a continuation of application Ser. No. 638,597, filed 8/7/84, now abandoned.

BACKGROUND OF THE INVENTION

This invention relates to peristaltic pumps which utilize flexible tubing. More particularly this invention relates to an improved mounting system for the surface against which flexible tubing is compressed in a peristaltic pump.

The operability of peristaltic pumps depends on the successive and repetitive compression of a length of flexible tubing which causes the fluid within the length of flexible tubing to flow. Accuracy of fluid flow from a peristaltic pump can only be maintained if the amount of compression of the flexible tubing can be duplicated each time a new piece of flexible tubing is operatively engaged with a peristaltic pump head.

Problems have arisen in maintaining accurate fluid flow rates in peristaltic pumps because of the varying sizes and durometers of flexible tubing employed. The problem of maintaining accurate fluid flow rates is compounded with increasing viscosities of the fluid to be pumped. In addition if the flexible tubing is not properly positioned with respect to the pump rotor and the surface against which it is compressed or if the pump head has a slight eccentricity, the rotating pump head may bind against the flexible tubing thus causing the rotation of the pump head to cease. Various attempts to overcome these problems have been made by adjustably mounting those portions of a peristaltic pump which repetitively and successively compress the flexible tubing. This adjustable mounting is designed to provide self correction for eccentricities in the pump head itself or irregularities in the flexible tubing. While improving performance these adjustable mounting systems have made peristaltic pump heads difficult to clean and difficult to manipulate when placing the flexible tubing in contact with the pump rotor.

These problems of the prior art have been overcome by the present invention which encompasses a floating compression surface for use with a peristaltic pump. The floating compression surface is biased into position with respect to the pump rotor and against the flexible tubing so that it applies a constant force on the flexible tubing as the pump rotor turns. As those portions of the pump rotor repetitively and successively compress the flexible tubing the surface against which the flexible tubing is compressed will rotate on a pivot mount. This rotation will allow the compression surface to respond to any irregularities in the pump rotor or in the flexible tubing. In this manner flexible tubing of varying sizes and durometers may be used with a single pump head without affecting pump accuracy.

SUMMARY OF THE INVENTION

The device of the present invention is a compression surface for use with a peristaltic pump. Peristaltic pumps typically include rollers which successively and repetitively compress flexible tubing in order to maintain flow of fluid through flexible tubing. In order for the flexible tubing to be compresed a surface must be provided against which the rollers may compress the flexible tubing. The pressure surface of the present invention includes a plate member which has an arcuate surface against which the flexible tubing is compressed. The plate member is mounted on a pivot so that it may rotate with respect to the peristaltic pump head. Biasing means hold the plate member in operative engagement with the flexible tubing when the tubing is placed in operative engagement with the peristaltic pump head. In this manner the arcuate pressure surface floats on the flexible tubing while at the same time exerting a constant force against the flexible tubing for maintaining accuracy of fluid flow.

BRIEF DESCRIPTION OF THE DRAWINGS

The device of the present invention may be better understood by reference to the drawings wherein.

DESCRIPTION OF THE EMBODIMENTS

Figure 1:
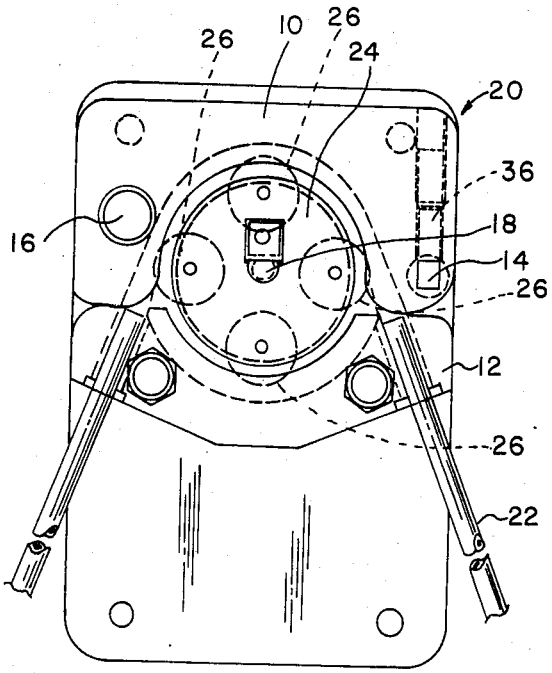
FIG. 1 is a front elevational view of a peristaltic pump, incorporating the pressure surface of this invention.

Utilization of the device of the present invention may be best understood by reference to peristaltic pump, generally 20 as shown in FIG. 1. Pump 20 consists of four main parts; specifically tubing guide piece 12, flexible tubing 22, rotatable pump head 24 and pressure plate 10. As pump head 24 rotates, pressure wheels 26 contact flexible tubing 22 to repetitively and successively compress flexible tubing 22. Arcuate surface 11 of pressure plate 10 operatively engages flexible tubing 22 to provide a surface against which pressure wheels 26 may compress flexible tubing 22. If desired arcuate surface may be bordered by a fence 13 which acts to retain flexible tubing 22 in operative engagement with a pump head 24.

Figure 2:
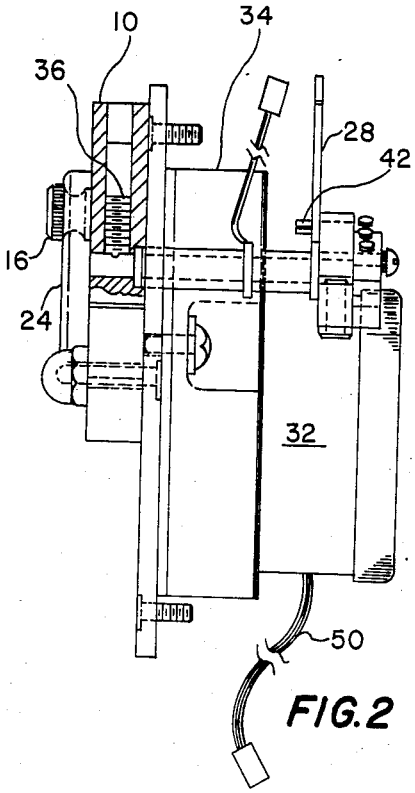
FIG. 2 is a side elevational view partially in section of the peristaltic pump of FIG. 1.
Figure 3:
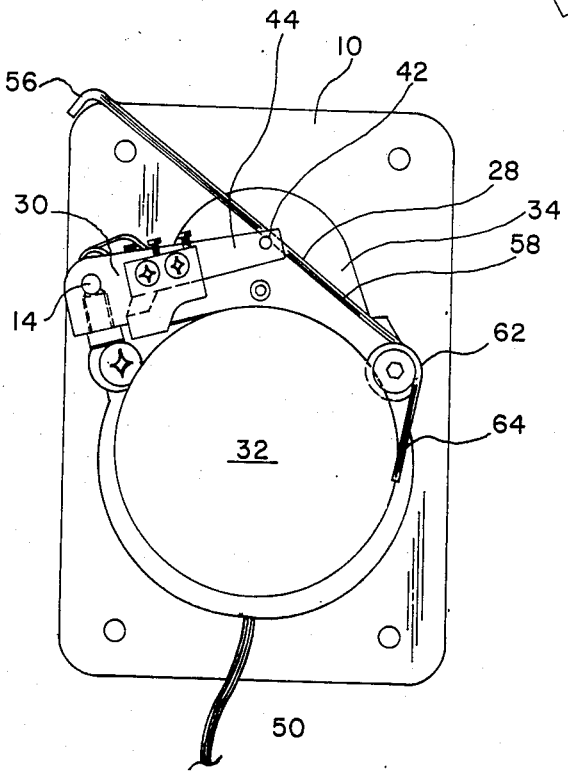
FIG. 3 is a rear elevational view of the peristaltic pump of FIG. 1.
Figure 5:
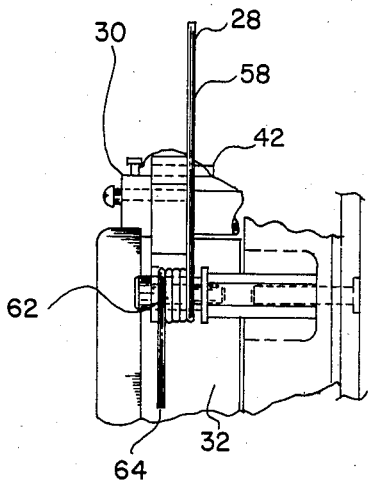
FIG. 5 is a partial side elevational view taken at line 5—5 of FIG. 4.

FIG. 2 illustrates the mounting of pressure plate 10 with respect to pump head 24. A rotatable pivot bar 14 extends through pressure plate 10. Pressure plate 10 is held in place on rotatable pivot bar 14 by set screw 36. As shown in FIGS. 3 and 5 arm 44 is attached to the opposite end of pivot bar 14. An electrical switch 30 may be placed on arm 44 to indicate the position of arm 44.

Pressure plate 10 is held in position by spring 28. Spring 28 consists of a spring retainer 64, a coil portion 62, a straight portion 58 and a bent-over portion 56. The action of straight portion 58 against cam finger 42 causes arm 44 to be biased in a downward manner. This downward biasing of arm 44 causes pump pressure plate 10 to remain in contact with and provide a surface for the compression of flexible tubing 22.

Operation

Figure 4:
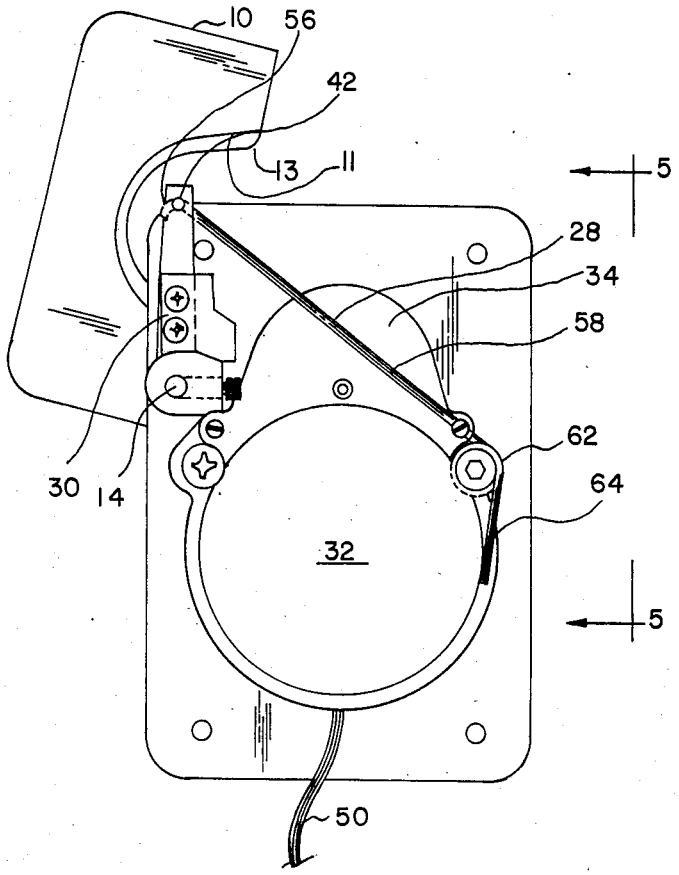
FIG. 4 is a view similar to FIG. 3; however, the pressure surface has been moved away from the pump rotor.

When it is desired to operatively engage flexible tubing 22 with pump head 24 to operate peristaltic pump 20 pressure plate 10 is moved out of the way as shown in FIG. 4. As shown in FIG. 1 flexible tubing 22 may now be threaded through tubing guide 12 and over pressure wheels 26. When flexible tubing 22 is properly in place pressure plate 10 may be moved back into position over flexible tubing 22 by manually grasping knob 16 and moving it into contact with flexible tubing 22. If desired an automatic spring return may be used. As can be best seen by comparing FIGS. 3 and 4 the moving of pressure plate 10 causes cam finger 42 to slide down straight portion 58 of spring 28. Electrical switch 30 will signal the position of the pressure head 10.

When electrical power is applied through lead 50 to motor 32 a rotating motion is imparted through speed reducer 34 to drive axle 18. Drive axle 18 causes rotatable pump head 24 to rotate. As rotatable pump head 24 rotates the incompressibility of fluid and the size and durometer of flexible tubing 22 will cause pressure plate 10 to move or float with respect to pivot bar 14 as the pump operates. Spring 28 provides a biasing force for pressure plate 10 against flexible tubing 22.

When the requisite amount of fluid has been pumped to the patient the rotation of rotatable pump head 24 may be stopped and flexible tubing 22 may be removed from the peristaltic pump 20. This removal of flexible tubing 22 is accomplished by grasping knob 16 and moving pressure plate 10 up and away from flexible tubing 22 to the position shown in FIG. 4. As pressure plate 10 is moved away from rotatable pump head 24 cam finger 42 slides up along the straight portion of spring 28. When cam finger 42 reaches bent-over portion 56 of spring 28 the downward force felt at bent-over portion 56 caused by the action of coil portion 62, held in place by spring retainer 64, will allow pressure plate 10 to remain in the open position. If the automatic return is used plate 10 will return to the closed position when released. Closing of pressure plate 10 again is easily affected by grasping knob 16 and moving pressure plate 10 back into contact with flexible tubing 22.

In this manner pressure surface 10 around rotatable peristaltic pump head 24 is allowed to rotate on the pivot bar 14 in response to any eccentricities in the rotating pump head or irregularities in the flexible tubing.

The foregoing invention can now be practiced by those skilled in the art. Such skilled persons will know that the invention is not necessarily restricted to the embodiments presented herein. The scope of the invention is to be defined by the terms of the following claims, as given meaning by the preceding description.

I claim:

1. A peristaltic pump comprising:

a length of flexible tubing:

a rotatable pump head having a plurality of pressure wheels constructed and arranged for repetitive and successive compression of said flexible tubing;

a plate member having an arcuate surface against which said flexible tubing may be compressed by said pressure wheels;

a mechanical spring operatively associated with said plate member to retain said plate member in an open position;

a pivot member operatively associated with said plate member to position said plate member with respect to said rotatable pump head and said flexible tubing; and means for resiliently biasing said arcuate surface against said compressible tubing;

whereby when said plate member is rotated on said pivot member into a position for operative engagement with said flexible tubing, said means for resiliently biasing said pump head will hold said arcuate surface in operative engaement with said flexible tubing.

* * * * *